US008047816B2

(12) United States Patent
Fujii et al.

(10) Patent No.: US 8,047,816 B2
(45) Date of Patent: Nov. 1, 2011

(54) CENTRIFUGAL PUMP

(75) Inventors: Yoshio Fujii, Kyoto (JP); Kenichiro Hamagishi, Kyoto (JP); Toshinobu Shinohara, Kyoto (JP)

(73) Assignee: Nidec Corporation, Kyoto (JP)

( * ) Notice: Subject to any disclaimer, the term of this patent is extended or adjusted under 35 U.S.C. 154(b) by 1071 days.

(21) Appl. No.: 11/860,861

(22) Filed: Sep. 25, 2007

(65) Prior Publication Data

US 2008/0080975 A1 Apr. 3, 2008

(30) Foreign Application Priority Data

Sep. 28, 2006 (JP) ..... 2006-264166

(51) Int. Cl.
*F04B 35/04* (2006.01)
*H02K 5/10* (2006.01)
*B63H 1/26* (2006.01)

(52) U.S. Cl. ..... 417/423.7; 417/423.14; 416/223 B; 416/235; 416/244 R; 310/86; 310/156.43

(58) Field of Classification Search ..... 417/423.1, 417/423.7, 423.12; 416/185, 223 B, 235, 416/237, 244 R; 310/43, 44, 156.43, 156.38, 310/86, 87, 216.112
See application file for complete search history.

(56) References Cited

U.S. PATENT DOCUMENTS

| | | | | |
|---|---|---|---|---|
| 3,938,914 | A * | 2/1976 | Zimmermann | 417/420 |
| 5,064,346 | A * | 11/1991 | Atarashi et al. | 416/178 |
| 6,506,034 | B1 * | 1/2003 | Lentz et al. | 417/423.8 |
| 6,663,362 | B1 * | 12/2003 | Lentz et al. | 417/423.7 |
| 7,182,579 | B2 * | 2/2007 | Roso et al. | 416/204 A |
| 7,253,543 | B2 * | 8/2007 | Akiyama | 310/63 |
| 7,692,355 | B2 * | 4/2010 | Ihle et al. | 310/257 |
| 7,713,030 | B2 * | 5/2010 | Tanahashi | 416/236 R |
| 7,744,350 | B2 * | 6/2010 | Ogino et al. | 416/178 |
| 2003/0118467 | A1 * | 6/2003 | Sato et al. | 419/66 |
| 2005/0151440 | A1 | 7/2005 | Yamashita et al. | |

FOREIGN PATENT DOCUMENTS

| | | | |
|---|---|---|---|
| CN | 2229558 | Y | 6/1996 |
| JP | 5213041 | A | 8/1993 |
| JP | 11139146 | A | 5/1999 |
| JP | 2004142596 | A | 5/2004 |
| JP | 2006219043 | A | 8/2006 |

* cited by examiner

*Primary Examiner* — Charles Freay
(74) *Attorney, Agent, or Firm* — Keating & Bennett, LLP

(57) ABSTRACT

An electric pump for use with an engine in a vehicle is provided. The electric pump has an impeller having a plurality of blades for moving coolant. A working surface of each blade is formed to be a flat plane which extends generally straight in both an axial direction and a radial direction. The electric pump is formed by a centrifugal pump. When the electric pump is not operating and is used as a portion of a coolant passage, flowing resistance can be reduced as compared with a case where the working surface of each blade is curved.

15 Claims, 12 Drawing Sheets

CENTRIFUGAL PUMP

BACKGROUND OF THE INVENTION

1. Field of the Invention

The present invention relates to a centrifugal pump. More particularly, the present invention relates to a centrifugal pump which is mounted on a vehicle for assisting circulation of liquid.

2. Description of the Related Art

In recent years, the number of vehicles having an "idle stop" function has been increasing for helping stop global warming. The idle stop function is turning off an engine when a vehicle is stopped, for example, at a red light, so as to reduce emissions. The idle stop function also makes vehicles more efficient.

In vehicles using a re-heat type air conditioning system, however, when the engine is stopped by the idle stop function, hot coolant from the engine is not delivered to a heater core. This may lower a heating performance of the air conditioning system. In order to avoid this problem, vehicles are usually equipped with an electric pump which operates to circulate coolant when the engine is stopped.

That electric pump does not operate while the engine is operating, but forms a portion of a coolant passage from the engine to the heater core. Thus, an impeller of the electric pump may interfere with a coolant flow in the passage if the impeller has a particular shape. In this case, flowing resistance in the coolant passage from the engine to the heater core, especially inside the electric pump, is increased, and may lower flow efficiency of coolant from the engine to the heater core. In particular, when a passenger rides in a vehicle, the flow resistance in a case where the electric pump forms a portion of the coolant passage is important because a period during which the engine is operating is longer than a period during which the engine is stopped.

SUMMARY OF THE INVENTION

According to preferred embodiments of the present invention, an electric centrifugal pump is provided. When the centrifugal pump is not operating, it is used as a portion of a liquid passage. The centrifugal pump includes: a case forming an outer shape of the centrifugal pump and including an inflow portion and an outflow portion; a pump chamber provided inside the case and including a passage of liquid; an impeller arranged in the pump chamber and rotatable about an axis to help generation of a vortex flow of the liquid which flows into the pump chamber from the inflow portion and flows out to the outflow portion; a magnetically driving portion rotatable about the axis together with the impeller; and an armature facing the magnetically driving portion with a gap arranged therebetween and generating a rotational magnetic field. The number of magnetic poles of the armature is 4 and the phase of the armature is 2.

The impeller includes a plurality of blades which are arranged radially about the axis at circumferential intervals. The blades extend generally straight in both a radial direction and an axial direction. Please note that the radial direction is perpendicular to the axis of rotation of the impeller and the axial direction is parallel to that axis.

The centrifugal pump further includes: a shaft coaxial with the axis of rotation of the impeller and fixed at a lower end thereof to the case; and a sleeve rotatable about the axis together with the impeller and the magnetically driving portion. The sleeve has an inner circumferential surface slidable on an outer circumferential surface of the shaft above the lower end of the shaft.

At an upper end of the shaft is provided a sleeve retaining portion which prevents axially upward movement of the sleeve. The sleeve retaining portion projects upward from the upper end of the shaft beyond an upper surface of the sleeve, and has a portion axially facing the upper surface of the sleeve. The sleeve retaining portion is arranged axially below axial upper ends of the blades.

Other features, elements, advantages and characteristics of the present invention will become more apparent from the following detailed description of preferred embodiments thereof with reference to the attached drawings.

DETAILED DESCRIPTION OF PREFERRED EMBODIMENTS

Figure 1:
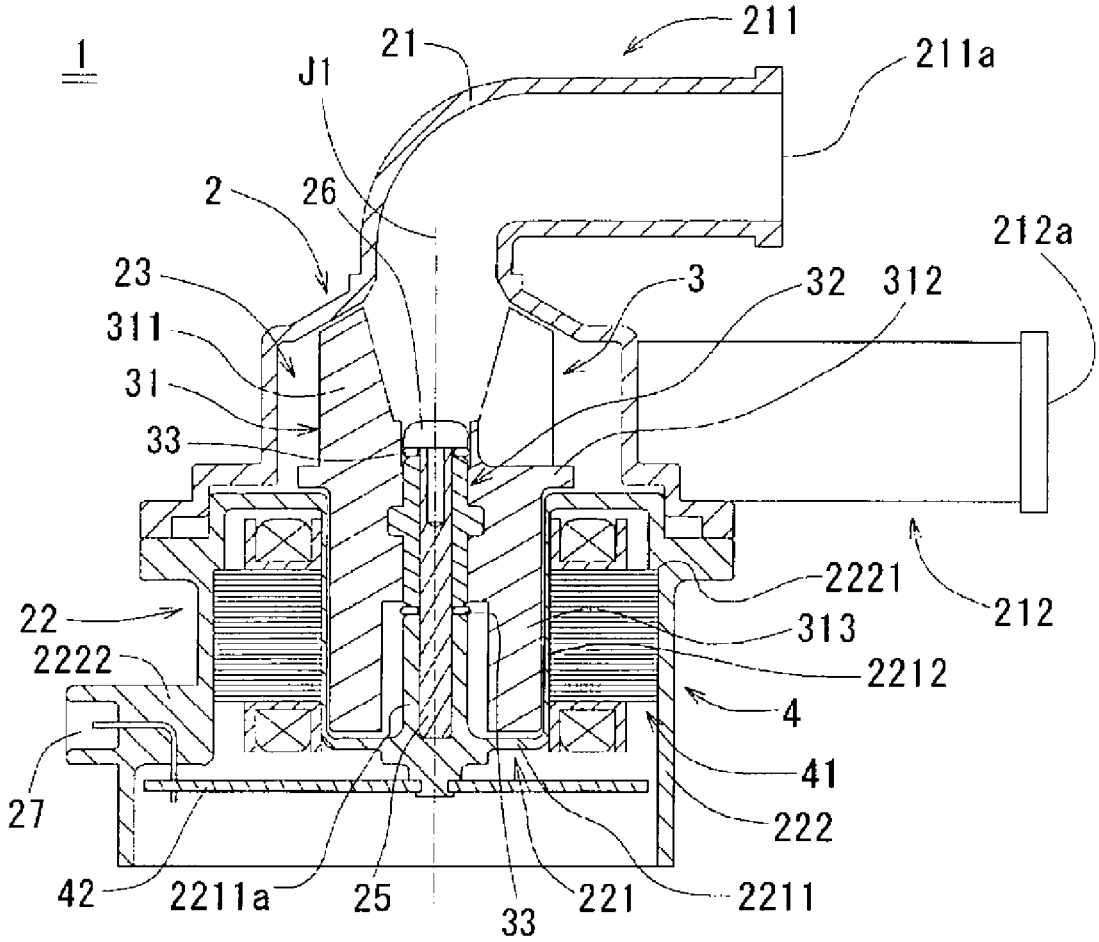
FIG. 1 is a cross-sectional view of a centrifugal pump according to a preferred embodiment of the present invention, taken along a rotation axis of its impeller.

Referring to FIGS. 1 through 11, preferred embodiments of the present invention will be described in detail. It should be noted that in the explanation of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel to a rotation axis, and a radial direction indicates a direction perpendicular to the rotation axis.

<Overall Structure of Centrifugal Pump>

An electric pump 1 as a centrifugal pump according to a preferred embodiment of the present invention is now described referring to FIG. 1. FIG. 1 is a cross-sectional view of the electric pump 1 taken along its center axis.

Referring to FIG. 1, the electric pump 1 includes a pump portion 2, a rotor portion 3 including an impeller 31 arranged in the pump portion 2 and being rotatable about a predetermined center axis J1, and a stationary portion 4 including an armature 41 arranged outside the pump portion 2. The pump portion 2 includes an inflow portion 211 having a liquid inlet 211*a*, an outflow portion 212 having a liquid outlet 212*a*, and a pump chamber 23 forming a portion of a liquid passage of an air conditioning system described later. An example of liquid flowing into the pump chamber 23 is coolant or cooling water. In the following description, the liquid inlet 211*a* side and the armature 41 side in an axial direction along the center axis J1 are referred to as an upper side and a lower side, respectively. However, the center axis J1 is not always coincident with the direction of gravity.

The pump portion 2 includes an upper case 21 and a lower case 22 which are fitted to each other. In the upper case 21, the inflow portion 211 and the outflow portion 212 are formed integrally with each other. The lower case 22 has a cup-shaped portion 221 formed by a cylindrical portion 2212 which is substantially cylindrical about the center axis J1 and a bottom portion 2211 covering an axially lower end of the cylindrical portion 2212. For example, the upper case 21 and the lower case 22 are formed by resin molding and are fixed to each other by vibration welding.

On the bottom portion 2211 of the cup-shaped portion 221 of the lower case 22, a shaft fixing portion 2211*a* is formed to extend upward along the center axis J1. The shaft fixing portion 2211*a* is hollow and cylindrical and is open at its upper end. A shaft 25 extending along the center axis J1 is fixed to an upper portion of the shaft fixing portion 2211*a*.

The rotor portion 3 includes a generally cylindrical sleeve 22 into which the shaft 25 is inserted. The sleeve 32 has an inner circumferential surface slidable on an outer circumferential surface of the shaft 25. On an outer circumferential surface of the sleeve 32 is formed an impeller 31. The impeller 31 is molded integrally with the sleeve 32, for example, by insert molding. The impeller 31 includes: a plurality of blades 311 which can generate a liquid flow in the pump chamber 23 when being turned; a blade root portion 312 fixing inner side surfaces and lower surfaces of the blades 311 to one another as one unit; and a magnetically driving portion 313 which is generally cylindrical and extend along the center axis J1 below the blade root portion 312. In this preferred embodiment four blades 311 are provided. The magnetically driving portion 313 is substantially entirely accommodated in the cup-shaped portion 221 of the lower case 22.

A thrust washer 33 for allowing sliding of the sleeve 32 in the axial direction and the radial direction is arranged at each of axial ends of the sleeve 32. The lower thrust washer 33 arranged below the sleeve 32 is sandwiched between a lower surface of the sleeve 32 and an upper end of the shaft fixing portion 2211*a*. The upper thrust washer 33 arranged above the sleeve 32 is sandwiched between an upper surface of the sleeve 32 and a screw 26 fixed to an upper surface of the shaft 25. More specifically, the screw 26 includes a first portion having an outer diameter larger than that of a portion of the shaft 25 facing the sleeve 32, and a second portion projecting from the first portion. The shaft 25 is provided with a concave fixing portion which is formed in its upper surface and into which the second portion of the screw 26 is to be inserted. The screw 26 is fixed to the upper surface of the shaft 25 by inserting the second portion into the concave fixing portion. In this state, the upper thrust washer 33 is sandwiched between a lower surface of the first portion of the screw 26 and the upper surface of the sleeve 32. Thus, the screw 26 and the upper thrust washer 33 can restrict axially upward movement of the sleeve 32. In other words, the screw 26 and the upper thrust washer 33 form together a retaining member recited in the claims.

The stationary portion 4 includes an armature 41 arranged around an outer circumferential surface of the cylindrical portion 2212 of the cup-shaped portion 221, and a circuit board 42 arranged below the armature 41 and electrically connected to the armature 41. The circuit board 42 has electronic parts mounted thereon, e.g., a hall element (not shown) for detecting a magnetic pole of the magnetically driving portion 313 and a switching device (not shown) for switching outputs of respective phases, such as a transistor. Rotation of the rotor portion 3 is controlled by controlling power supply to the armature 41.

A generally cylindrical outer wall 222 is formed radially outside the cup-shaped portion 221 of the lower case 22. The outer wall 222 is generally coaxial with the cup-shaped portion 221. The outer wall 222 has a step 2221 on its inner circumferential surface. The step 2221 has a planar surface extending inwardly in the radial direction. When the armature 41 comes into contact with the step 2221, the armature 41 is positioned in the axial direction. In the radial direction, the armature 41 is positioned by coming into contact at its radially inner portion with the outer circumferential surface of the cylindrical portion 2212 of the cup-shaped portion 221.

On the outer surface of the outer wall 222, an outer extension 2222 is formed which extends outwardly in the radial direction. In this preferred embodiment, the outer extension 2222 is not formed over the entire circumferential length of the outer wall 222 but is formed to have a certain circumferential length. A connector 27 is integrally molded with the outer extension 2222. The connector 27 extends outwardly in the radial direction and is electrically connected to the circuit board 42. A current supplied from an external power supply (not shown) is supplied to the armature 41 through the connector 27 and the circuit board 42. A rotational magnetic field generated by the armature 41 and the magnetically driving portion 313 generate together a rotational torque about the center axis J1, thereby rotating the rotor portion 3.

<Impeller Structure>

Figure 2:
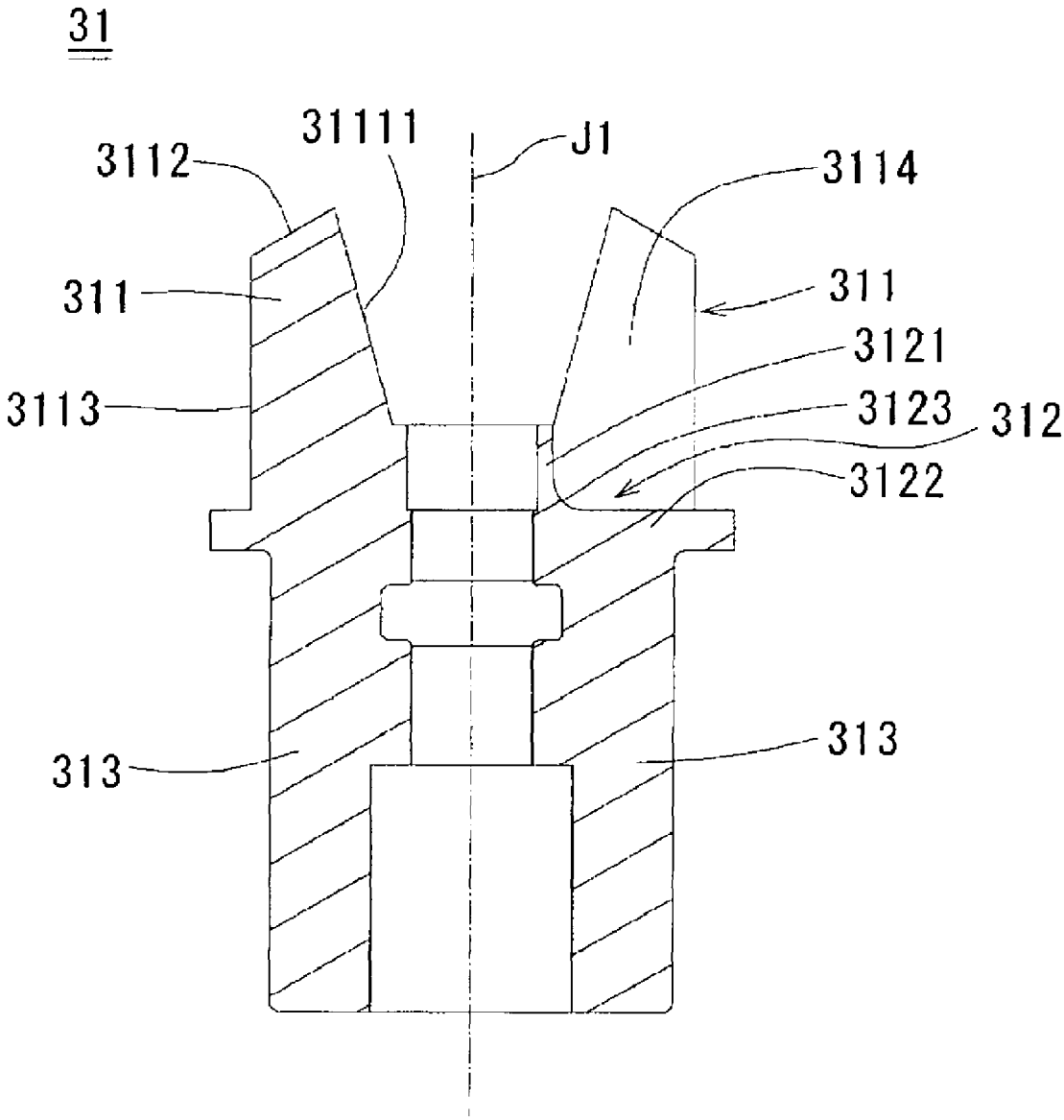
FIG. 2 is a cross-sectional view of an exemplary impeller of the centrifugal pump of FIG. 1, taken along the center axis of the centrifugal pump.
Figure 3:
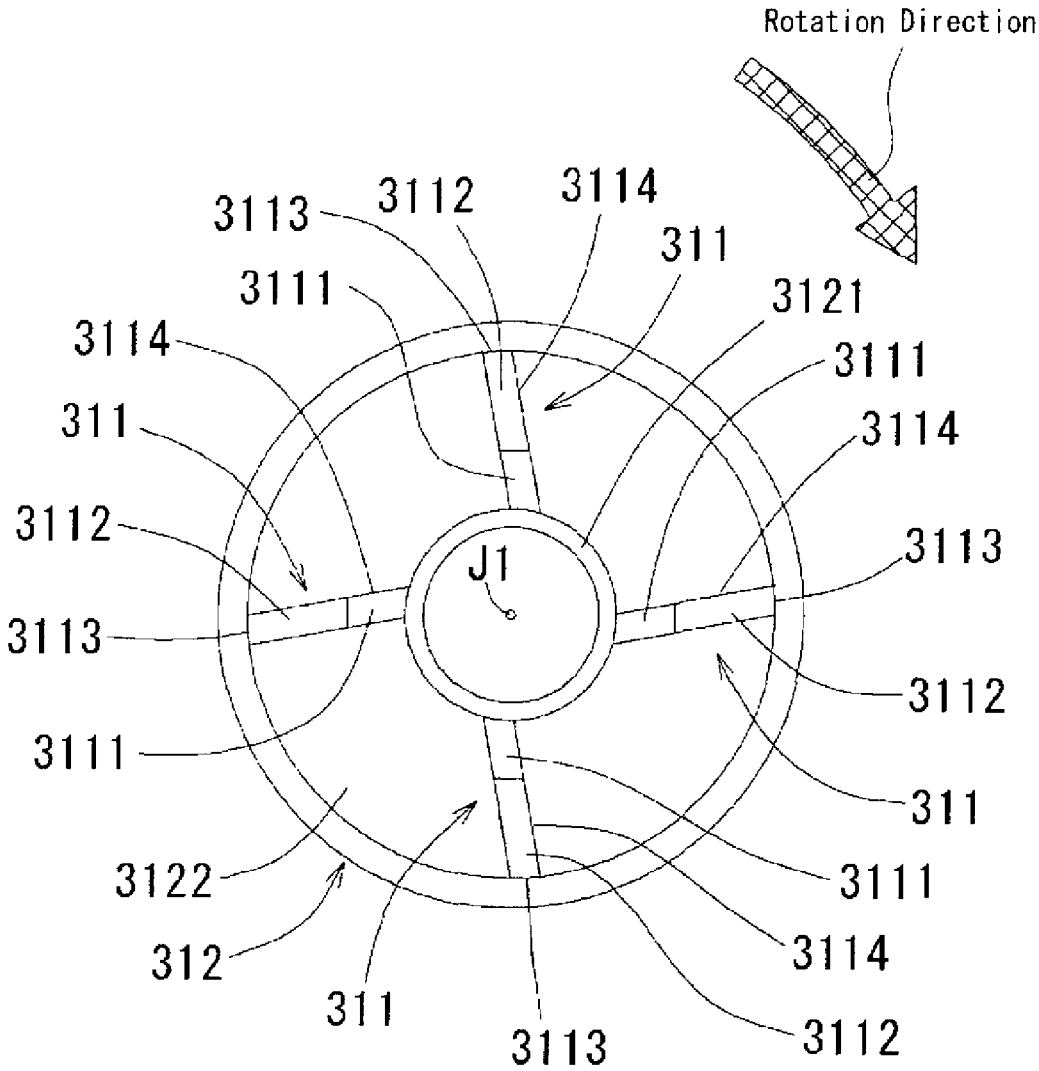
FIG. 3 is a plan view of the impeller of FIG. 2, seen from above.

The structure of the impeller 31 is now described referring to FIGS. 2 and 3. FIG. 2 is a cross-sectional view of the impeller 31 taken along the center axis J1. FIG. 3 is a plan view of the impeller 31 seen from above.

Referring to FIG. 2, the blade root portion 312 of the impeller 31 includes a cylindrical portion 3121 extending along the center axis J1 and a circular plate portion 3122 extending from the cylindrical portion 3121 outwardly in the radial direction. The cylindrical portion 3121 continues to radially inner edges of the blades 311 and supports them in the radial direction. The circular plate portion 3122 continues to lower ends of the blades 311.

A curved surface 3123 is formed at a position where the cylindrical portion 3121 continues to the circular plate portion 3122. Below the circular plate portion 3122 is arranged the magnetically driving portion 313 which is substantially cylindrical and has an outer diameter smaller than that of the circular plate portion 3122. In this preferred embodiment, the impeller 31 is molded from plastic magnet, e.g., ferrite plastic, as a single member. The plastic magnet is used because of its good moldability.

The magnetically driving portion 313 is molded to have anisotropy. Especially in this preferred embodiment, the magnetically driving portion 313 has polar anisotropy. Thus, magnetic force of the magnetically driving portion 313 is larger than that of an isotropic magnetically driving portion. Therefore, the rotational torque about the center axis J1 applied to the rotor portion 3 is larger. The magnetically driving portion 313 has four magnetic poles arranged in the circumferential direction.

Each blade 311 has an inner inclined surface 3111 and an outer inclined surface 3112 radially outside the inner inclined surface 3111. The inner inclined surface 3111 is inclined with respect to the center axis J1 such that its radially inner end is located at the lowest position. The outer inclined surface 3112 is also inclined with respect to the center axis J1 but its radially outer end is located at the lowest position Each blade 311 further has an outermost surface 3113 which continues to the outer inclined surface 3112. The outermost surface 3113 extends from the radially outer end of the outer inclined surface 3112 downwardly in the axial direction.

Referring to FIG. 3, a working surface 3114 of each blade 311, which substantially contributes to generation of a liquid flow, is a flat plane generally parallel to the center axis J1. The working surface 3114 is inclined with respect to the radial direction such that its radially outer end is located on an upstream side of its radially inner end in a rotation direction of the impeller 31. Since the electric pump 1 of this preferred embodiment is driven by a single-direction rotation of a shaft 325 (described later) such that the impeller 31 rotates in the rotation direction shown in FIG. 3, it is possible to design the working surface 3114 to be inclined in the above-described manner.

<Structure of Pump Portion>

Figure 4:
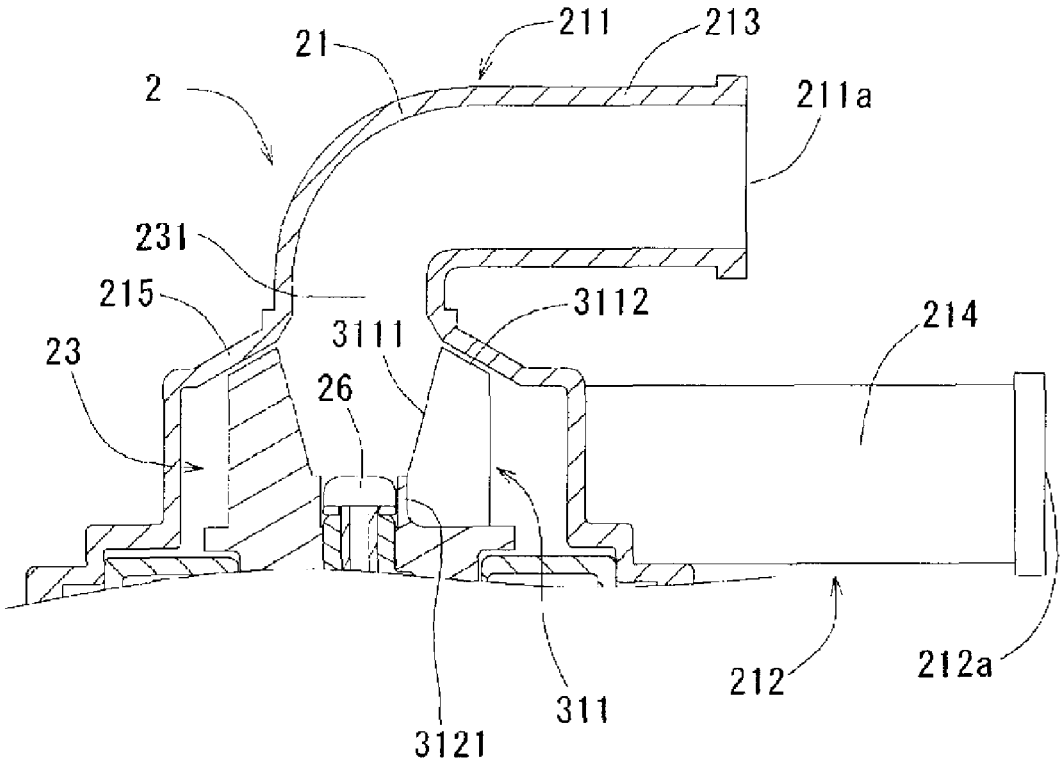
FIG. 4 is an enlarged view of a pump portion of the centrifugal pump of FIG. 1.
Figure 5:
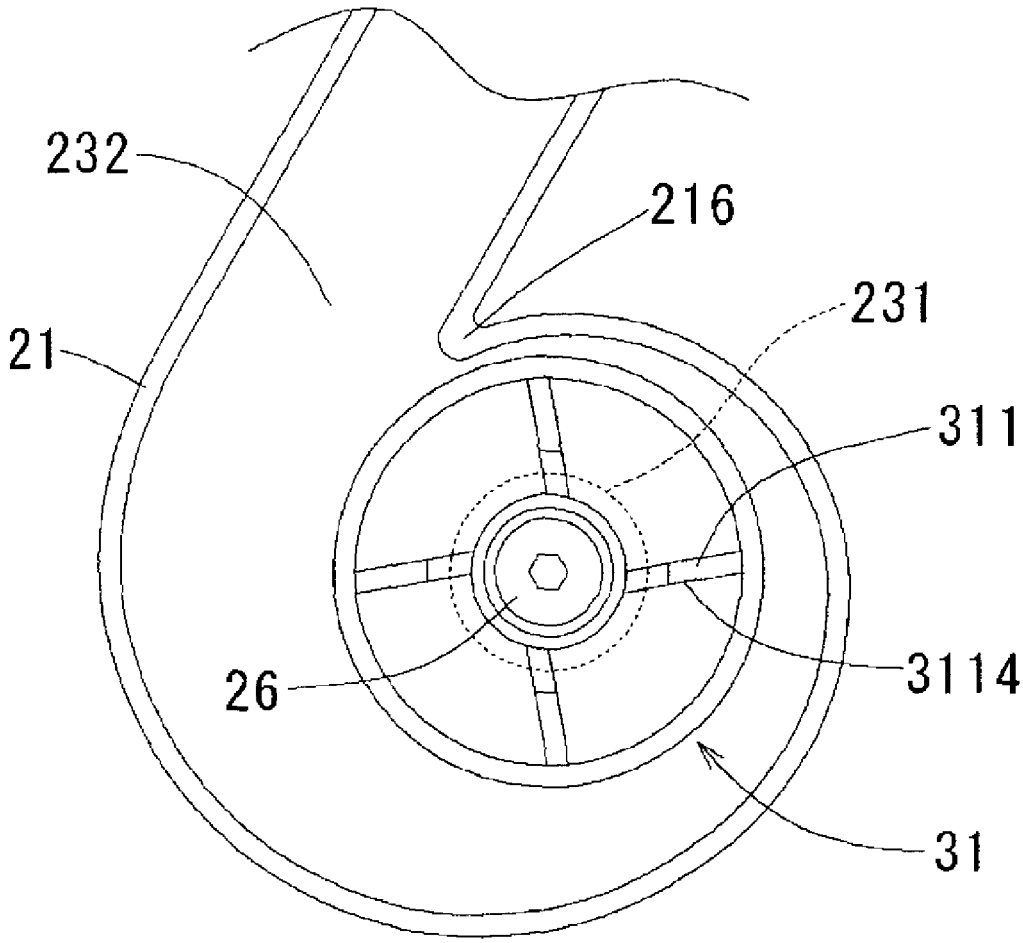
FIG. 5 is a plan view of the pump portion of FIG. 4, seen from above.

The structure of the pump portion 2 and a liquid flow are now described referring to FIGS. 4 and 5. FIG. 4 is an enlarged view of a part of the electric pump 1 of FIG. 1 around the pump chamber 23. FIG. 5 is a plan view of the pump chamber 23 seen from above. In FIG. 5, broken circle represents a pump inflow port 231 through which liquid flows into the pump chamber 23.

Referring to FIG. 4, the liquid inlet 211*a* of the inflow portion 211 is arranged such that liquid flows into the liquid inlet 211*a* in a direction generally perpendicular to the center axis J1. A first connecting pipe 213 is formed by a single continuous member so as to extend from the liquid inlet 211*a* to the pump chamber 23. The first connecting pipe 213 is connected to the pump chamber 23 to extend parallel to the center axis J1 from the pump chamber 23. That is, the pump inflow port 231 is open to allow liquid to flow into the pump chamber 23 along the center axis J1. Thus, the first connecting pipe 213 is formed to be generally L-shaped.

As shown in FIG. 5, the pump inflow port 231 has an inner diameter equal to or larger than a largest diameter of an imaginary closed curve connecting radially innermost points of the blades 311 of the impeller 31. Thus, liquid flowing via the pump inflow port 231 is allowed to flow smoothly toward radially outermost portions of the blades 311.

The liquid outlet 212*a* of the outflow portion 212 is open to be generally parallel to the liquid inlet 211*a*. A second connecting pipe 214 extending from the liquid outlet 212*a* to the pump chamber 23 is formed integrally with the liquid outlet 212*a*, and is connected a pump outflow port 232 (see FIG. 5) from which liquid exits from the pump chamber 23.

An inner wall of the upper case 21, which continues to the pump inflow port 231, has an inclined portion 215 which faces and generally parallel to the outer inclined surface 3112 of each blade 311. Thus, a diameter of a liquid passage defined in the upper case 21 increases at the inclined portion 215 toward the pump chamber 23. It is preferable that a distance between the inclined portion 215 and the outer inclined surface 3112 of each blade 311 be minimized. In this case, flowing resistance of liquid flowing from the pump inflow port 231 to the pump outflow port 232 can be reduced, thus reducing loss of the liquid in the pump chamber 23. Moreover, since the inclined portion 215 and the outer inclined surface 3112 are formed to be at an angle to the axial direction such that an inner diameter of the inclined portion 215 increases toward the pump chamber 23, the resistance of liquid flowing from the pump inflow port 231 to the pump outflow port 232 can be reduced. This also reduces loss of the liquid in the pump chamber 23. Accordingly, a pumping efficiency can be improved.

The screw 26 is accommodated in a space surrounded by the inner circumferential surface of the cylindrical portion 3121 of the blade root portion 312. An upper end of the screw 26 is arranged axially below an uppermost point of each blade 311 at which the inner inclined surface 3111 and the outer inclined surface 3112 cross each other. It is especially preferable that the upper end of the screw 26 be at the same level as or below an upper end of the cylindrical portion 3121. By arranging the upper end of the screw 26 below the uppermost points of the blades 311, it is possible to prevent the screw 26 from interfering with the liquid flow entering from the pump inflow port 231. That is, it is possible to prevent the screw 26 from increasing the resistance of liquid.

As shown in FIG. 4, the screw 26 and the upper thrust washer 33 forming a sleeve retaining portion are arranged below the pump inflow port 231 at which the inflow portion 211 is directly connected to the pump chamber 23, and are arranged inside the blades 311 of the impeller 31. The largest outer diameter of the screw 26 and the thrust washer 33 is smaller than an imaginary closed curve of radially innermost points of the blades 311 of the impeller 31. This configuration enables the liquid to flow more smoothly. Moreover, the pump chamber 23 can be made compact and therefore the entire electric pump 1 can be downsized. In addition, this configuration allows the blades 311 to be made larger. The larger blades 311 and the smaller pump chamber 23 contribute together to increase in the flow amount of the liquid while the electric pump 1 is operating.

Referring to FIG. 5, a portion of the upper case 21, which is adjacent to the pump outflow port 232, forms an edge 216. A dimension of the radial gap between the impeller 31 and the inner wall of the upper case 21 is the smallest at a position between the edge 216 and the impeller 31 and continuously increases from the edge 216 along the rotation direction of the impeller 31.

<Flow of Liquid>

Figure 6:
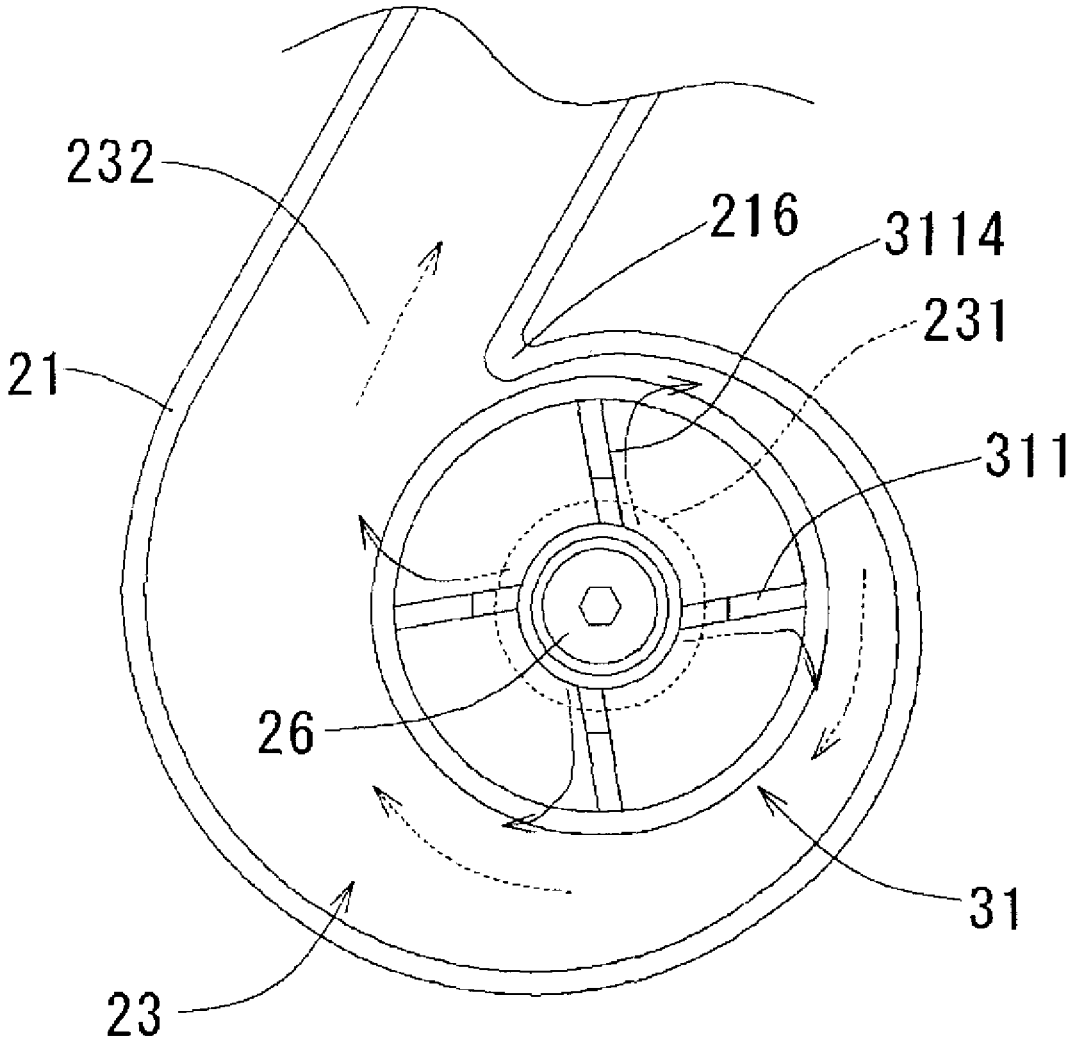
FIG. 6 is a plan view of the centrifugal pump of FIG. 5 when the centrifugal pump is operating.
Figure 7:
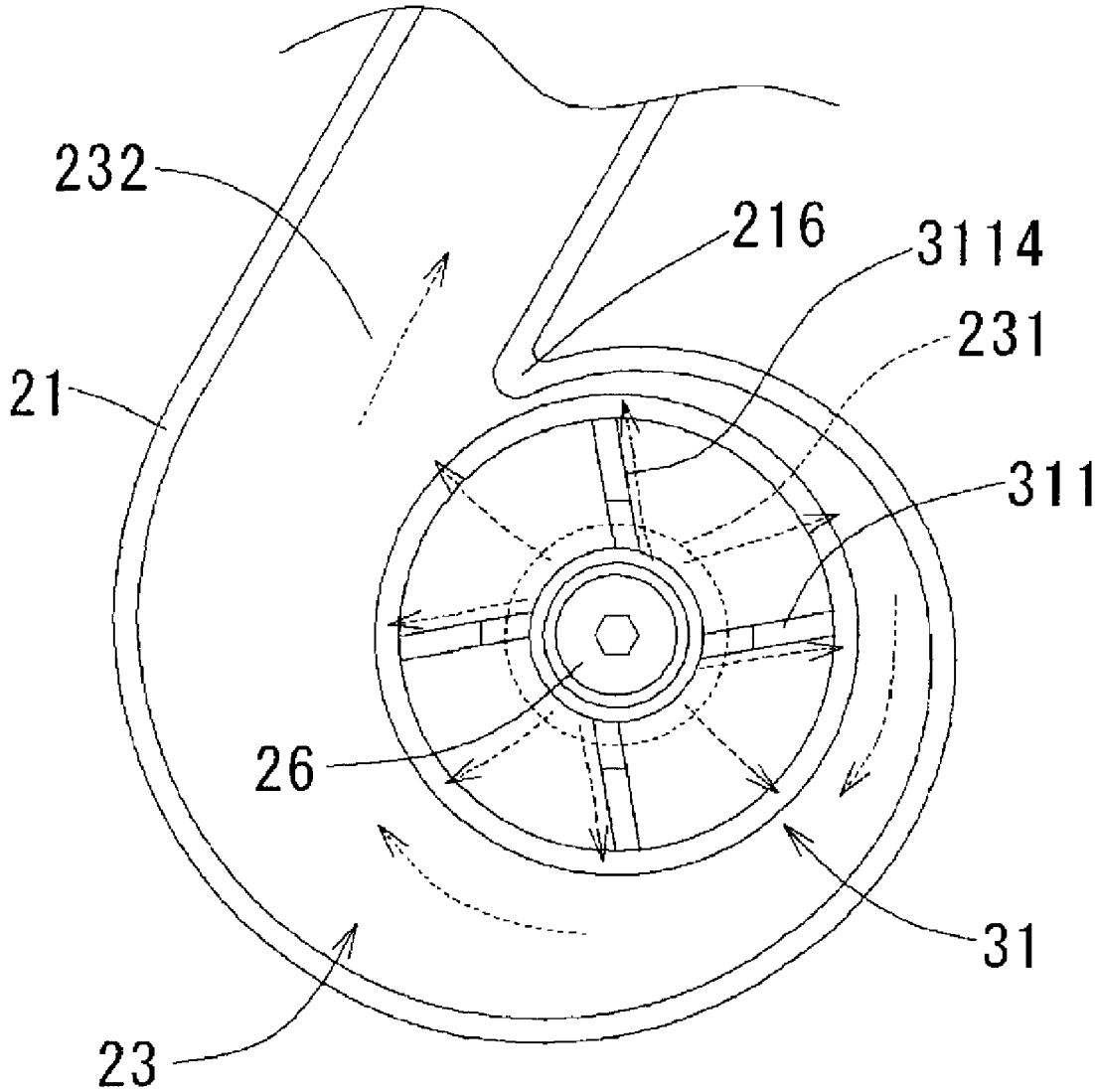
FIG. 7 is a plan view of the centrifugal pump of FIG. 5 when the centrifugal pump is not operating.
Figure 8A:
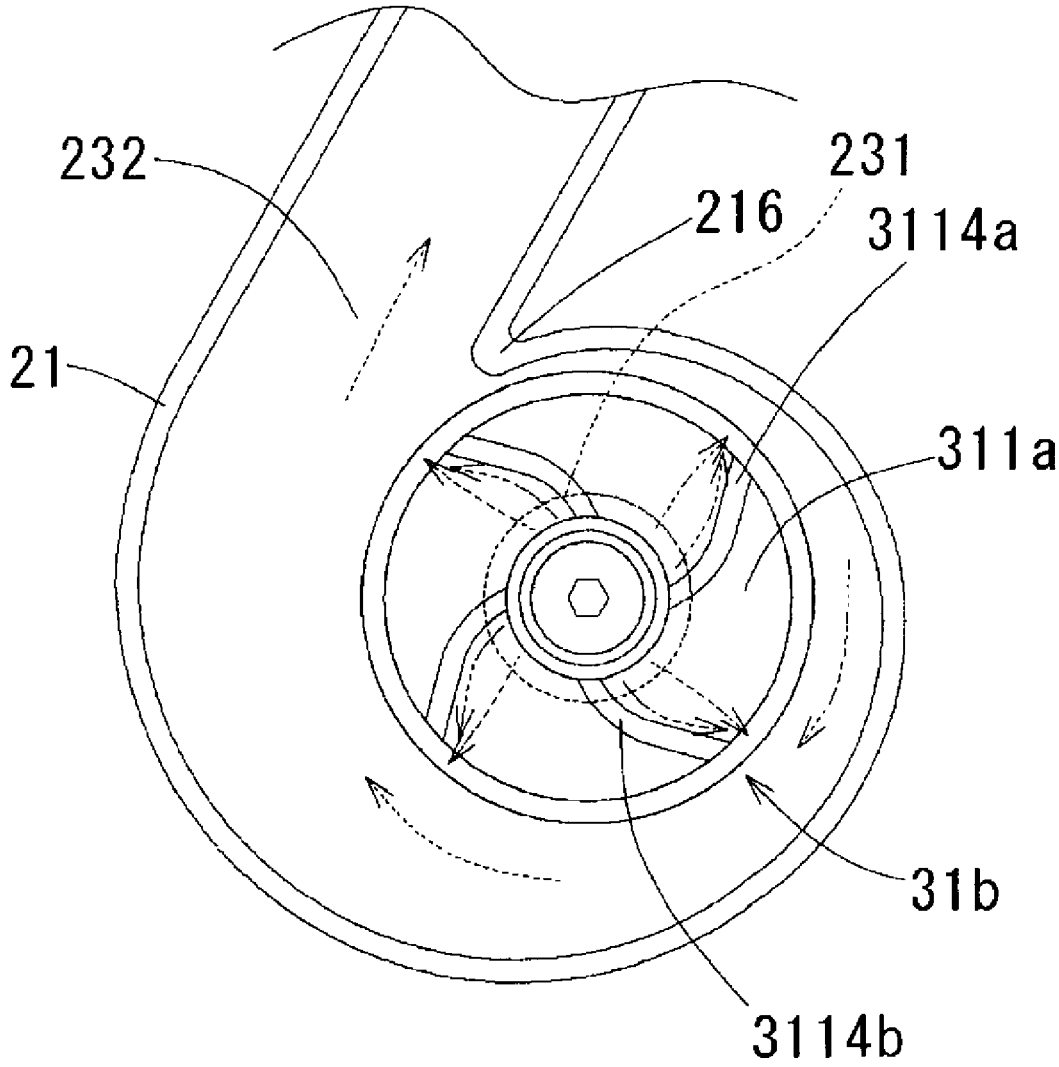
FIG. 8A is a plan view of an exemplary pump portion in which impeller blades are curved with respect to a radial direction.
Figure 8B:
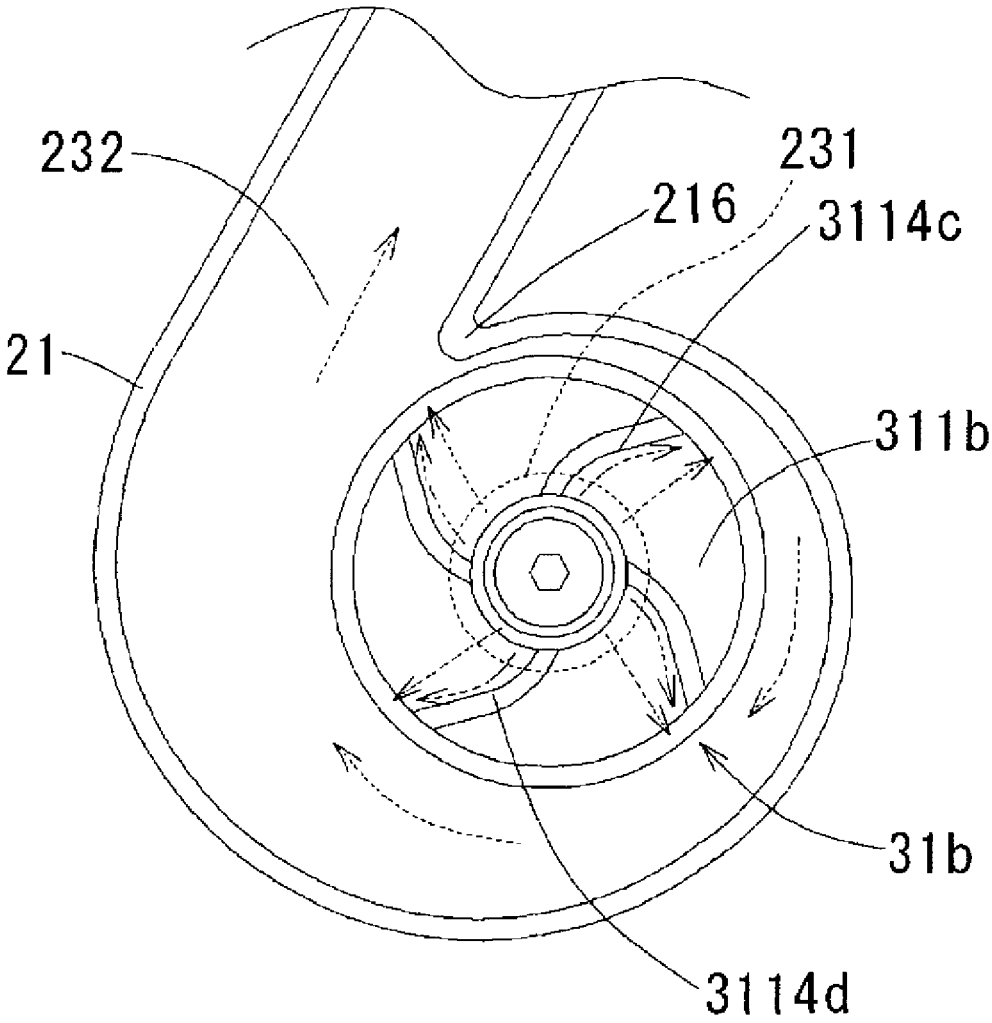
FIG. 8B is a plan view of another exemplary pump portion in which impeller blades are curved with respect to a radial direction.

The flow of liquid is now described referring to FIGS. 6, 7, 8A and 8B. FIG. 6 shows the flow of liquid while the electric pump 1 is operating and FIG. 7 shows it while the electric pump 1 is not operating. In FIGS. 6 and 7, the pump chamber 23 is shown in the same manner as that of FIG. 5. FIGS. 8A and 8B are plan views of exemplary pump chamber as viewed from above, showing the liquid flow while the electric pump 1 is not operating in a case where the working surface is curved. FIG. 8A shows a case where the working surface is convex toward a downstream side in the rotation direction, and FIG. 8B shows a case where the working surface is convex toward an upstream side in the rotation direction.

Referring to FIG. 6, when the electric pump 1 is operating, liquid swirls from the edge 216. The working surface 3114 makes the liquid flow in the rotation direction and outwardly in the radial direction. More specifically, since the working surface 3114 is inclined with respect to the radial direction such that its radially outer end is located on an upstream side of its radially inner end in the rotation direction of the impeller 31, force sliding on the working surface 3114 outwardly in the radial direction is generated and forces the liquid outwardly in the radial direction. Therefore, the liquid flowing from the pump inflow port 231 to the blades 311 is directed outwardly in the radial direction by the blades 311. Consequently, a pressure of the liquid around the blades 311 is lowered, and therefore the liquid from the pump outflow port 232 is made to flow efficiently. Thus, pumping efficiency is improved.

Referring to FIG. 7, while the electric pump 1 is not operating, liquid flows outwardly in the radial direction between the blades 311 adjacent to each other in the circumferential direction. Then, the liquid flows along the inner wall of the upper case 21 toward the pump outflow portion 232.

Referring to FIGS. 8A and 8B, a case is considered where a working surface of each blade includes a curved portion. In the example of FIG. 8A, the working surface 3114*a* of each blade 311*a* of the impeller 31*a* is curved so as to be convex toward the downstream side in the rotation direction. Thus, a curved portion 3114*b* in a conventional device. In this example, liquid flowing on and along the working surface 3114*a* flows along the curved portion 3114*b* and hits against liquid flowing in the rotation direction along the inner wall of the upper case 21, causing large turbulence. This turbulence forms resistance against the liquid flowing from the pump inflow port 231 to the pump outflow port 232. In other words, the flowing resistance becomes larger.

In the example of FIG. 8B, the working surface 3114*c* of each blade 311*b* of the impeller 31*b* is curved so as to be convex toward the upstream side in the rotation direction. Thus, a curved portion 3114*d* is formed. Liquid flowing on and along the working surface 3114*b* flows along the curved portion 3114*d* and therefore hits against liquid flowing between the blades 311*b* circumferentially adjacent to each other. Thus, large turbulence is generated. This forms resistance against water flowing from the pump inflow port 231 to the pump outflow port 232. In other words, the flowing resistance is increased.

As compared with the working surfaces 3114*a* and 3114*c* shown in FIGS. 8A and 8B, the working surface 3114 of the blade 311 of the impeller 31 of this preferred embodiment is generally straight in both the radial direction and the axial direction. Therefore, it is possible to prevent liquid flowing along the working surface 3114 from hitting against liquid flowing between the blades 311 circumferentially adjacent to each other. This means the flowing resistance can be reduced.

<Armature>

Figure 9:
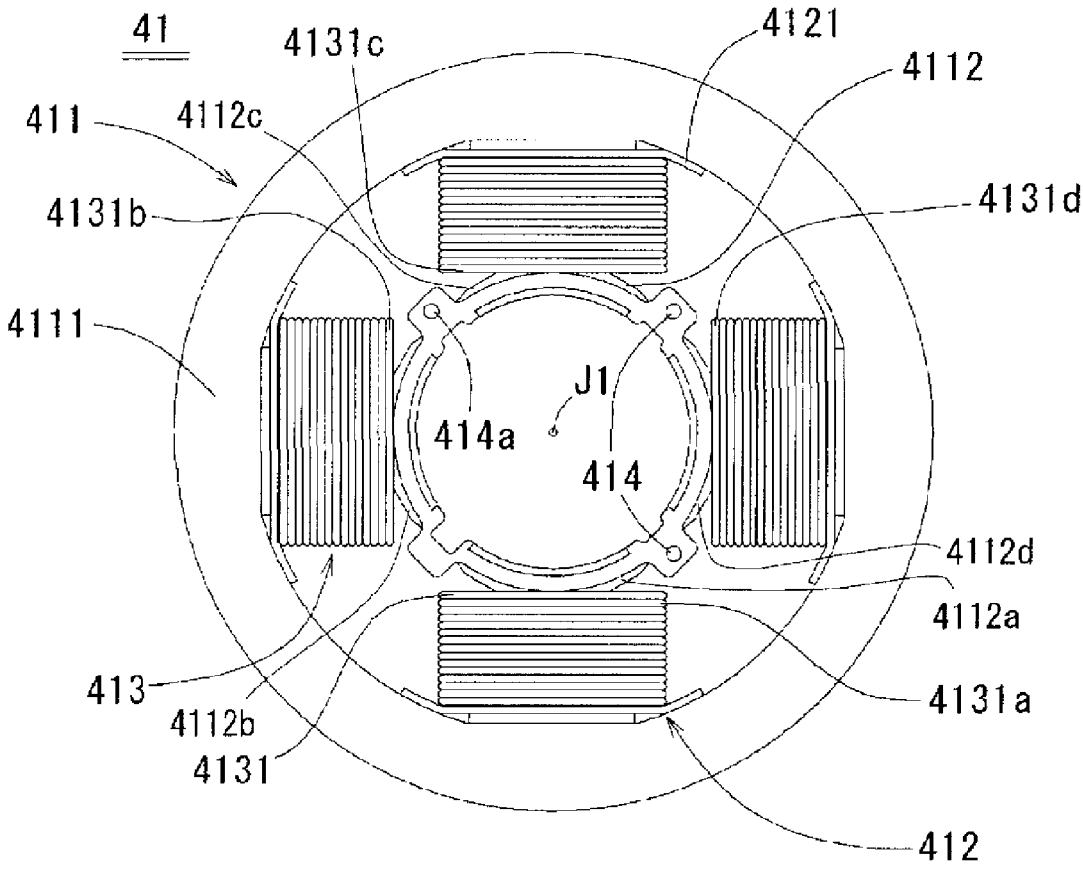
FIG. 9 is a plan view of an armature of the centrifugal pump of FIG. 1.

The structure of the armature 41 is now described referring to FIG. 9. FIG. 9 is a plan view of the armature 41 as viewed from above.

The armature 41 includes a stator core stack 411, two insulators 412 covering the stator core stack 411 from axially above and below, and coil windings 413 formed by winding conductive wires 4131 around the insulator 412 multiple times. The stator core stack 411 is formed by stacking a plurality of thin steel plates, which are magnetically conductive, along the center axis J1.

The stator core stack 411 includes an annular core back 4111 and a plurality of teeth 4112 extending from the core back 4111 toward the center axis J1. The teeth 4112 are arranged at a circumferential separation. In this preferred embodiment, four teeth 4112 are provided. The core back 4111 and the teeth 4112 may be formed as separate components which are then fitted to each other. Since four teeth 4112 are provided in this preferred embodiment, the number of magnetic poles of the armature 41 is four.

The insulators 412 are fitted to the teeth 4112 from axially above and below so as to cover the teeth 4112 except for radially inner surfaces of the teeth 4112. Each insulator 412 has a circumferential extension 4121 covering a radially inner surface of the core back 4111.

The coil windings 413 are formed by winding two conductive wires 4131 of U and V phases around corresponding teeth 4112 in a concentrated manner. More specifically, the U-phase conductive wire 4131*a* is continuously wound around two teeth 4112*a* and 4112*c* radially facing each other, while the V-phase conductive wire 4131*b* is continuously wound around two teeth 4112*b* and 4112*d* radially facing each other. Winding starts of the U-phase conductive wire 4131*a* and the V-phase conductive wire 4131*b* are respectively connected to connection pins 414 which are apart from each other in the circumferential direction. Winding ends of the conductive wires 4131*a* and 4131*b* are both connected to a common connection pin 414*a*, thereby forming a neutral node.

In this preferred embodiment, since the number of the magnetic poles is 4, cogging torque is large. That is, the circumferential distance between the circumferentially adjacent teeth 4112 can be made larger as compared with an armature having five or more magnetic poles. In particular, the armature 41 of this preferred embodiment has two phases. Thus, the number of slots is 4. The number of generation of cogging torque per one revolution of the rotor portion 3 is given by the least common multiple of the number of slots and the number of magnetic poles. Therefore, when the number of slots is 4, the least common multiple of the number of slots and the number of magnetic poles can be made small. For example, a case is considered where the number of magnetic poles is 4. In this case, when the number of slots is 4, the least common multiple of the number of slots and the number of magnetic poles is 4. When the number of slots is different, for example, 3 which is the smallest number of slots in a three-phase motor, the least common multiple of the number of slots and the number of magnetic poles is 12. Even if the number of magnetic poles is 2 which is the smallest, the least common multiple is 4 when the number of slots is 4, and is 6 when the number of slots is 3. This means that, if the total magnitude of cogging torque is the same, the magnitude of single cogging torque is larger as the number of generation of cogging torque per one revolution is smaller. Thus, when the electric pump 1 of this preferred embodiment is used as a portion of the liquid passage, the blades 311 cannot be easily turned when a liquid flow in the pump chamber 23 hits against the blades 311. Consequently, when the electric pump 1 of this preferred embodiment is used as a portion of the liquid passage, i.e., is used in a non-operation state, adverse effects of a back electromotive force on the circuit board 42 can be reduced. This is favorable especially to a switching device on the circuit board 42 because it is sensitive to the back electromotive force. Moreover, since the blades 311 of the impeller 31 cannot be easily turned, liquid flowing from the pump inflow port 231 to the pump outflow port 232 is not used for work for turning the blades 31. Thus, loss of liquid flow can be prevented, resulting in reduction in flowing resistance.

<Air Conditioning System>

Figure 10:
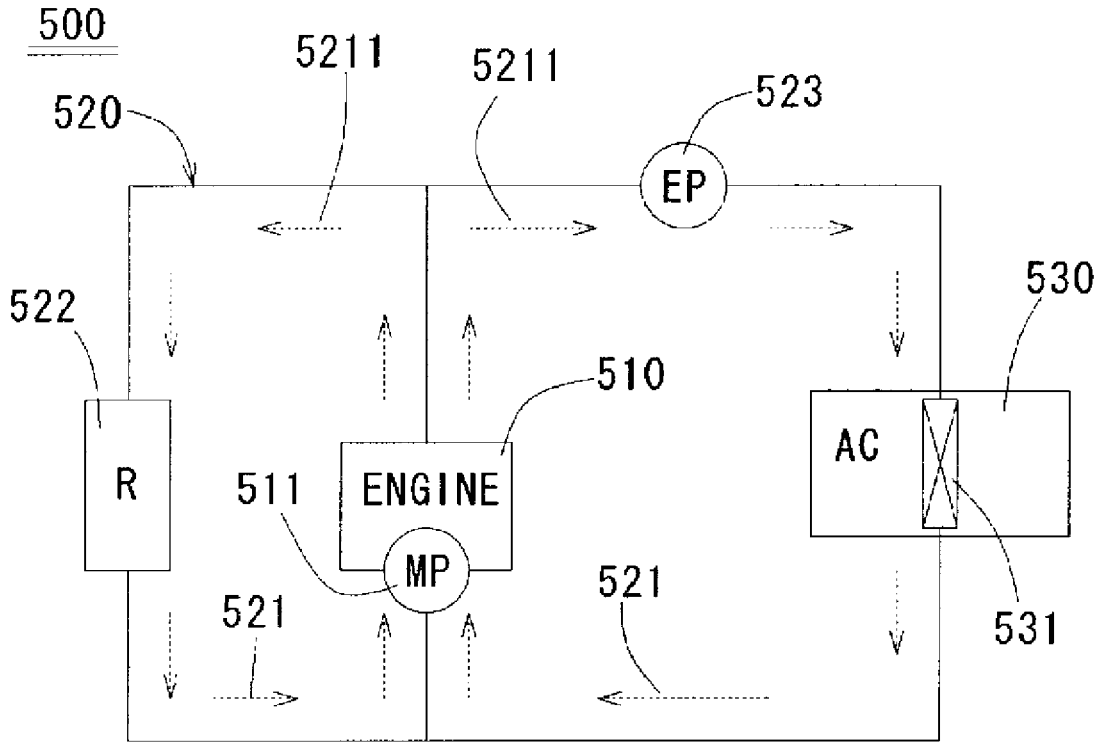
FIG. 10 illustrates an air conditioning system according to a preferred embodiment of the present invention.
Figure 11:
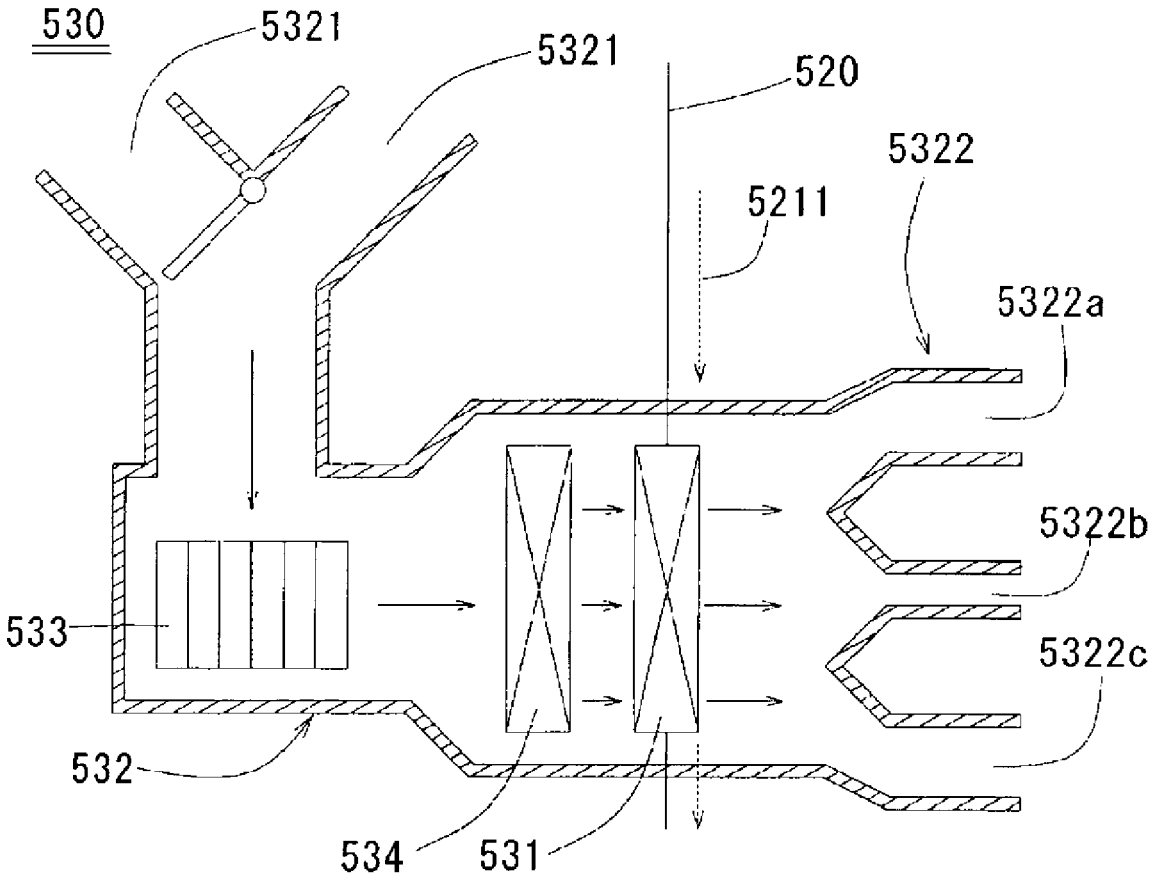
FIG. 11 illustrates an air conditioner according to a preferred embodiment of the present invention.

An air conditioning system with no air-mix door for a vehicle is now described referring to FIGS. 10 and 11. This air conditioning system may be called as a reheat type air conditioning system. FIG. 10 shows an example of the entire reheat type air conditioning system according to a preferred embodiment of the present invention. FIG. 11 shows an exemplary air conditioner included in the air conditioning system of FIG. 10. Each of broken arrows in FIGS. 10 and 11 indicates a flow of coolant 521 or 5211. Solid arrow in FIG. 11 indicates an air flow.

<Entire Structure of Air Conditioning System>

Referring to FIG. 10, the reheat type air conditioning system 500 includes a coolant circuit 520 in which coolant 521 for cooling an engine 510 flows, and an air conditioner 530 which forms a portion of the coolant circuit 520 and can send cold air and hot air.

Near the engine 510 is arranged a mechanical engine-powered pump 511.

The coolant circuit 520 includes a radiator 522 for air-cooling the coolant 521 from the engine 510, which has heat absorbed from the engine 510, and an electrical pump 521 for helping a flow of the coolant 521 to the air conditioner 530.

The air conditioner 530 includes a heater core 531 for absorbing the heat of the coolant 5211.

<Air Conditioner>

Referring to FIG. 11, the air conditioner 530 includes a ventilation duct 532 which forms an outer shape of the air conditioner 530, a blower fan 533 accommodated in the ventilation duct 532 and generating an air flow, an evaporator 534 cooling the air flow generated by the blower fan 533, and the heater core 531 heating the air flow generated by the blower fan 533.

The ventilation duct 532 includes an air inlet 5321 taking air from the outside and a plurality of air outlets 5322 discharging air in the ventilation duct 532 to the outside (inside a vehicle). The air outlets 5322 include a windshield air outlet 5322*a* for a windshield defroster which sends air toward a windshield of a vehicle (not shown), a face air outlet 5322*b* which sends air toward an upper body of a passenger (not shown), and a foot air outlet 5322*c* which sends air to a lower body of the passenger.

The blower fan 533 sends air from the air inlet 5321 to the evaporator 534 and the heater core 531. The evaporator 534 and the heater core 531 are arranged in the ventilation duct 532 with almost no space between them.

In a case of sending cold air to the inside of a vehicle, the evaporator 354 itself is cooled by a cooling circuit (not shown) so that the air flow from the blower fan 533 is cooled and is then sent out from at least one of the air outlets 5322.

In a case of sending hot air to the inside of a vehicle, the heater core 531 itself is heated by the coolant circuit 520, so that the air flow from the blower fan 533 is heated. The heated air is sent out from at least one of the air outlets 5322.

<Coolant Flow>

1) Engine is Operating

Referring to FIG. 10, when the engine 510 is operating, the engine-powered pump 511 is also operating. Thus, the engine-powered pump 511 generates a flow of coolant 521 which flows toward the engine 510 and, after being heated by the engine 510, flows toward the heater core 531 and the radiator 522. In contrast, when the engine 510 is operating, the electric pump 523 is not operating and is used for a portion of a coolant passage.

2) Engine is not Operating

When the engine 510 is stopped, for example, because an idle stop function is activated, the engine-powered pump 511 is not operating. In contrast, the electric pump 523 is activated to operate. The electric pump 523 helps flow of coolant 521 or 5211 in the coolant circuit 520. Therefore, it is possible to deliver the coolant 521 or 5211 to the heater core 530. This configuration prevents lowering of a heating performance of the air conditioner 530 even when the engine 510 is not operating.

Especially when the electric pump 1 of the preferred embodiment of the present invention is used as the electric pump 523, it is possible to provide the air conditioning system having a low flowing resistance in the coolant circuit 520, in particular, in a portion from the engine 510 to the heater core 531 when the engine 510 is operating. Moreover, the electric pump 1 of the preferred embodiment of the present invention is more advantageous in a case where someone is in a vehicle, because a total duration in which the engine 510 is operating than a total duration in which the engine 510 is stopped by an auto idle stop function, for example.

The electric pump 1 and the air conditioning system 500 of the preferred embodiment of the present invention are described above. However, the present invention is not limited thereto but may be modified in various ways within the scope of the claims.

For example, in the electric pump 1 of the above preferred embodiment of the present invention, the upward movement of the sleeve 32 is restricted by the screw 26 and the thrust washer 33. However, the present invention is not limited thereto. Alternatively, the shaft 25 itself may be formed to have an approximately T-shaped cross section, so that the shaft 25 restricts the upward movement of the sleeve 32. Alternatively, another member may be fixed to the outside of the shaft 25 so that this member can restrict the upward movement of the sleeve 32 by coming into contact with the upper surface of the sleeve 32 at the lower surface thereof.

In addition, the impeller 31 in the above preferred embodiment is formed to include the magnetically driving portion 313, the blades 31, and the blade root portion 312 which are integrally molded with one another into one component. However, the present invention is not limited thereto. For example, the magnetically driving portion 313 may be formed as a substantially cylindrical rotor magnet, for example, made of ferrite magnet, and the blades 311 and the blade root portion 312 may be made of resin by molding integrally with each other. In this case, the material cost can be reduced because the blades 311 and the blade root portion 312 are made of resin.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An electric centrifugal pump comprising:

a case defining an outer shape of the centrifugal fan and including an inflow portion and an outflow portion;

a pump chamber provided inside the case and including a liquid passage;

an impeller arranged in the pump chamber and being rotatable about an axis to generate a vortex flow of the liquid which flows into the pump chamber via the inflow portion and flows out via the outflow portion;

a magnetically driving portion rotatable about the axis together with the impeller; and an armature facing the magnetically driving portion with a gap arranged therebetween, the armature being arranged to generate a rotational magnetic field;

a shaft arranged coaxial or substantially coaxial with the axis of rotation of the impeller and an axial lower end of the shaft being fixed to the case;

a sleeve rotatable about the axis together with the impeller and the magnetically driving portion and including an inner circumferential surface which is slidable on an outer circumferential surface of the shaft above the axially lower end of the shaft; and a sleeve retaining portion arranged above an upper end of the shaft, extending axially upward beyond an axial upper surface of the sleeve, and including a portion axially facing the axial upper surface of the sleeve to prevent axially upward movement of the sleeve; wherein the centrifugal pump defines a portion of the liquid passage from the inflow portion to the outflow portion, the impeller includes a plurality of blades radially arranged about the axis and circumferentially spaced from one another;

the blades are generally straight in both a radial direction perpendicular or substantially perpendicular to the axis and an axial direction parallel or substantially parallel to the axis;

the centrifugal pump is driven in a single rotation direction and a radially outer end of each of the blades is located circumferentially upstream from a radially inner end thereof with respect to the single rotation direction; and an axial uppermost end of the sleeve retaining portion is arranged axially below axially uppermost ends of the blades.

2. The centrifugal pump according to claim 1, wherein each of the blades includes an inner inclined surface in a radially inner portion thereof, a radially innermost portion of the inner inclined surface is axially lower than other portions of the inclined surface.

3. The centrifugal pump according to claim 2, wherein the impeller includes a blade supporting portion arranged to support the blades in the radial direction, and the inner inclined surface of each of the blades extends from an axially uppermost portion thereof to a connection where the blade supporting portion is connected to the blades.

4. The centrifugal pump according to claim 1, wherein the sleeve retaining portion includes a retaining member as a separate member from the shaft, the upper end of the shaft is provided with a concave fixing portion to which the retaining member is fixed, and the retaining member is a fixed portion arranged to be fixed to the concave fixing portion and an expansion portion having a larger outer diameter than that of a portion of the shaft which faces the sleeve.

5. The centrifugal pump according to claim 1, wherein the impeller includes a blade supporting portion arranged to support the blades in the radial direction, the blade supporting portion being substantially cylindrical, and the sleeve retaining portion is arranged inside the blade supporting portion in the radial direction.

6. The centrifugal pump according to claim 5, wherein the sleeve retaining portion is arranged axially below an axially upper end of the blade supporting portion.

7. The centrifugal pump according to claim 1, wherein the centrifugal pump is arranged between an engine for a vehicle and an air conditioner arranged to send cold air and hot air to inside of the vehicle, arranged to circulate coolant which cools the engine, and arranged to send the coolant from the engine to the air conditioner.

8. The centrifugal pump according to claim 7, wherein the centrifugal pump is operating when the engine is stopped by an idle stop function of the vehicle, and is not operating when the engine is operating, and when the centrifugal pump is not operating, it is used as a portion of the liquid passage with the coolant as the liquid.

9. An electric centrifugal pump comprising:

a case defining an outer shape of the centrifugal pump and including an inflow portion and an outflow portion;

a pump chamber provided inside the case and including a liquid passage;

an impeller arranged inside the pump chamber and being rotatable about an axis to generate a vortex flow of the liquid which flows into the pump chamber via the inflow portion and flows out via the outflow portion;

a magnetically driving portion rotatable about the axis together with the impeller; and an armature facing the magnetically driving portion with a gap arranged therebetween, the armature being arranged to generate a rotational magnetic field;

a shaft arranged coaxial or substantially coaxial with the axis of rotation of the impeller and an axial lower end of the shaft being fixed to the case;

a sleeve rotatable about the axis together with the impeller and the magnetically driving portion and including an inner circumferential surface which is slidable on an outer circumferential surface of the shaft above the axially lower end of the shaft; and a sleeve retaining portion arranged above an upper end of the shaft, extending axially upward beyond an axial upper surface of the sleeve, and including a portion axially facing the axial upper surface of the sleeve to prevent axially upward movement of the sleeve; wherein the centrifugal pump defines a portion of a passage in which the liquid flows from the inflow portion to the outflow portion when the centrifugal pump is not operating, the impeller includes a plurality of blades radially arranged about the axis and circumferentially spaced from one another; the armature includes a stator core stack including an annular core back and a plurality of magnetic poles extending in a radial direction perpendicular or substantially perpendicular to the axis, and coil windings arranged around the magnetic poles; a number of the magnetic poles is 4 and a number of phases of the armature is 2;

the centrifugal pump is driven in a single rotation direction and a radially outer end of each of the blades is located circumferentially upstream from a radially inner end thereof with respect to the single rotation direction; and an axial uppermost end of the sleeve retaining portion is arranged axially below axially uppermost ends of the blades.

10. The centrifugal pump according to claim 9, wherein the magnetically driving portion is anisotropic.

11. The centrifugal pump according to claim 9, wherein the magnetic poles of the stator core stack extend from the core back toward the axis of rotation of the impeller, and inner surfaces of the magnetic poles face an outer surface of the magnetically driving portion in the radial direction.

12. The centrifugal pump according to claim 9, wherein the centrifugal pump is arranged between an engine for a vehicle and an air conditioner arranged to send cold air and hot air to inside of the vehicle, arranged to circulate coolant which cools the engine, and arranged to send the coolant from the engine to the air conditioner.

13. The centrifugal pump according to claim 12, wherein the centrifugal pump is operating when the engine is stopped by an idle stop function of the vehicle, and is not operating when the engine is operating, and when the centrifugal pump is not operating, it is used as a portion of the liquid passage with the coolant as the liquid.

14. An electrical centrifugal pump comprising:

a case defining an outer shape of the centrifugal pump and including an inflow portion and an outflow portion;

a pump chamber provided inside the case and including a liquid passage;

an impeller arranged in the pump chamber and being rotatable about the axis to generate a vortex flow of the liquid which flows into the pump chamber via the inflow portion and flows out via the outflow portion, the impeller including blades;

a magnetically driving portion rotatable about the axis together with the impeller;

a shaft coaxial or substantially coaxial with the axis of rotation of the impeller and fixed at an axially lower end thereof to the case;

a sleeve rotatable about the axis together with the impeller and the magnetically driving portion and including an inner circumferential surface which is slidable on an outer surface of the shaft above the axially lower end of the shaft;

an armature facing the magnetically driving portion with a gap arranged therebetween, the armature being arranged to generate a rotational magnetic field; and a sleeve retaining portion arranged at an axially upper end of the shaft, extending axially upward beyond an upper surface of the sleeve, and including a portion axially facing the upper surface of the sleeve which is arranged to prevent axially upward movement of the sleeve, the impeller being arranged at the axially upper end of the shaft; wherein an axially uppermost end of the sleeve retaining portion is arranged axially below axially uppermost ends of the blades.

15. The centrifugal pump according to claim 14, wherein the sleeve retaining portion is arranged at approximately the same radial position as a pump inflow port at which the inflow portion is directly connected to the pump chamber, and is arranged radially inside the blades, and a largest diameter of an imaginary closed curve connecting radially innermost points of the blades is equal to or smaller than an imaginary closed curve connecting radially innermost points of an inner diameter of the pump inflow port and is larger than an outer diameter of a radially largest portion of the sleeve retaining portion.

* * * * *